US009430965B2

(12) United States Patent
Byun et al.

(10) Patent No.: US 9,430,965 B2
(45) Date of Patent: Aug. 30, 2016

(54) ORGANIC LIGHT EMITTING DISPLAY DEVICE AND DRIVING METHOD THEREOF

(71) Applicant: LG Display Co., Ltd., Seoul (KR)

(72) Inventors: Seung Chan Byun, Gyeonggi-do (KR); Hyung Rae Kim, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 76 days.

(21) Appl. No.: 14/096,180

(22) Filed: Dec. 4, 2013

(65) Prior Publication Data

US 2014/0152721 A1 Jun. 5, 2014

(30) Foreign Application Priority Data

Dec. 4, 2012 (KR) ..... 10-2012-0139641

(51) Int. Cl.
*G09G 5/10* (2006.01)
*G09G 3/32* (2016.01)

(52) U.S. Cl.
CPC ..... *G09G 3/3233* (2013.01); *G09G 3/3208* (2013.01); *G09G 2320/0673* (2013.01); *G09G 2330/021* (2013.01); *G09G 2340/16* (2013.01); *G09G 2360/16* (2013.01)

(58) Field of Classification Search
CPC ..... G09G 2320/0686; G09G 3/3291; G09G 3/3233; G09G 3/3208; G09G 2330/021; G09G 2340/16; G09G 2360/16
USPC ..... 346/691
See application file for complete search history.

(56) References Cited

U.S. PATENT DOCUMENTS

| | | | | |
|---|---|---|---|---|
| 2005/0057581 | A1* | 3/2005 | Horiuchi et al. | 345/690 |
| 2010/0066657 | A1 | 3/2010 | Park et al. | |
| 2010/0253664 | A1 | 10/2010 | Byun et al. | |
| 2012/0032998 | A1 | 2/2012 | An et al. | |

FOREIGN PATENT DOCUMENTS

| | | | |
|---|---|---|---|
| CN | 101562000 | A | 10/2009 |
| CN | 101814267 | A | 8/2010 |
| CN | 102376266 | A | 3/2012 |
| JP | 2005070426 | A | 3/2005 |
| JP | 2011254392 | A | 12/2011 |
| KR | 10-2002-0059488 | A | 7/2002 |

OTHER PUBLICATIONS

The First Office Action dated Jul. 15, 2015 from the State Intellectual Property Office of the People's Republic of China in counterpart Chinese application No. 201310625812.0.

* cited by examiner

*Primary Examiner* — Mark Regn
(74) *Attorney, Agent, or Firm* — Morgan, Lewis & Bockius LLP

(57) ABSTRACT

An organic light emitting display device includes a display panel including a plurality of pixels each having an organic light emitting element that emits light according to a current corresponding to a data voltage, and a panel driver configured to divide the display panel into first to Mth blocks, calculate an average picture level of each block from data to be displayed in each of the plurality of pixels of each block, convert the data to be displayed by each of the plurality of pixels of each block into the data voltage, and supply the data voltage to each of the plurality of pixels of each block, where the panel driver controls the data voltage to be supplied to an ith block on the basis of the average picture levels of M number of blocks previous to the ith block, where i is a natural number from 1 to M.

14 Claims, 4 Drawing Sheets

ORGANIC LIGHT EMITTING DISPLAY DEVICE AND DRIVING METHOD THEREOF

CROSS-REFERENCE TO RELATED APPLICATIONS

This application claims the benefit of priority of Korean Patent Application No. 10-2012-0139641 filed on Dec. 4, 2012, which is hereby incorporated by reference as if fully set forth herein.

BACKGROUND

1. Field of the Disclosure

The present disclosure relates to an organic light emitting display device, and more particularly, to control of a peak luminance of an organic light emitting display device such as that used in a display panel.

2. Discussion of the Related Art

With the advancement of multimedia, the importance of flat panel display (FPD) devices is increasing. Therefore, various FPD devices such as liquid crystal display (LCD) devices, plasma display panel (PDP) devices, and organic light emitting display devices are being used in practice. In such FPD devices, the organic light emitting display devices may typically have a fast response time of 1 ms or less, low power consumption, and no limitation in viewing angle because the organic light emitting display devices self-emit light. Accordingly, the organic light emitting display devices are attracting much attention as next generation FPD devices.

General organic light emitting display devices may apply a data voltage to each of a plurality of pixels to control a current flowing in an organic light emitting element according to a data current corresponding to the data voltage, thereby displaying a certain image.

Because the organic light emitting element is a self-emitting element, power consumption is changed according to an image. Therefore, by using a peak luminance control method, when an input image is a dark image, organic light emitting display devices of the related art increase a luminance of an image to realize a moving image, but when an input image is a bright image, the related art organic light emitting display devices decrease a luminance of an image to reduce power consumption.

A related art peak luminance control method detects an average picture level from an image of one frame, generates a peak luminance gain value according to the detected average picture level, and adjusts a luminance of the image on the basis of the generated peak luminance gain value. For example, when an input image is a dark image, the peak luminance gain value is generated as a relatively high value for increasing a luminance of the image, but when an input image is a bright image, the peak luminance gain value is generated as a low value for decreasing a luminance of the image.

However, in the organic light emitting display device using the related art peak luminance control method, and as illustrated in FIG. 1, when an input image is changed from a dark image to a bright image, a high peak luminance gain value calculated from the dark image is applied to the bright image to momentarily increase a current flowing in a display panel, and thus, a power supply or the like may be shut down due to the momentary peak current. While the adverse effects caused by this momentary peak current can be remedied when data to be displayed in a display panel is delayed for a time corresponding to one frame by using a frame memory, the cost of the display panel increases due to this frame memory.

SUMMARY

Accordingly, the present embodiments are directed to providing an organic light emitting display device and a driving method thereof that substantially obviate one or more problems due to limitations and disadvantages of the related art.

An aspect of the present embodiments is directed to providing an organic light emitting display device and a driving method thereof which can control a peak luminance with no adverse effect caused by a momentary peak current without using a frame memory.

Additional advantages and features of the present embodiments will be set forth in part in the description which follows and in part will become apparent to those having ordinary skill in the art upon examination of the following or may be learned from practice of the present embodiments. The objectives and other advantages of the present embodiments may be realized and attained by the structure particularly pointed out in the written description and claims hereof as well as the appended drawings.

To achieve these and other advantages and in accordance with the purpose of the present embodiments, as embodied and broadly described herein, there is provided an organic light emitting display device including: a display panel configured to include a plurality of pixels including an organic light emitting element that emits light with a current corresponding to a data voltage; and a panel driver configured to divide the display panel into first to Mth blocks, calculate an average picture level of each of the blocks from data to be displayed in each of a plurality of pixels of each block, convert data to be supplied to each of a plurality of pixels of each block into the data voltage, and supply the data voltage to each pixel, wherein the panel driver controls data voltages of respective pixels to be displayed in an ith (where i is a natural number that is one of one to M) block on the basis of average picture levels of M number of blocks previous to the ith block.

In another aspect of the present embodiments, there is provided a method of an organic light emitting display device, including a display panel that includes a plurality of pixels including an organic light emitting element that emits light with a current corresponding to a data voltage, including: performing an A operation of dividing the display panel into first to Mth blocks, and calculating an average picture level of each of the blocks from data to be displayed in each of a plurality of pixels of each block; and performing a B operation of converting data to be supplied to each of a plurality of pixels of each block into the data voltage to supply the data voltage to each pixel simultaneously with the A operation, wherein the B operation controls data voltages of respective pixels to be displayed in an ith (where i is a natural number that is one of one to M) block on the basis of average picture levels of M number of blocks previous to the ith block.

It is to be understood that both the foregoing general description and the following detailed description are exemplary and explanatory and are intended to provide further explanation of the present embodiments as claimed.

BRIEF DESCRIPTION OF THE DRAWINGS

The accompanying drawings, which are included to provide a further understanding of the present embodiments and are incorporated in and constitute a part of this application, illustrate examples of the present embodiments. In the drawings.

DETAILED DESCRIPTION OF THE INVENTION

Figure 1:
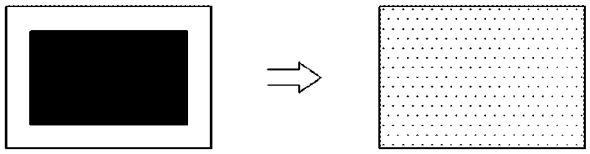
FIG. 1 Related Art
FIG. 1 is a diagram for describing a peak luminance control method of a related art organic light emitting display device.

In the specification, in adding reference numerals for elements in each drawing, it should be noted that like reference numerals may be used for like elements.

The terms described in the specification should be understood as follows.

As used herein, the singular forms "a", "an" and "the" are intended to include the plural forms as well, unless the context clearly indicates otherwise. The terms "first" and "second" are for differentiating one element from the other element, and these elements should not be limited by these terms.

It will be further understood that the terms "comprises", "comprising,", "has", "having", "includes" and/or "including", when used herein, specify the presence of stated features, integers, steps, operations, elements, and/or components, but do not preclude the presence or addition of one or more other features, integers, steps, operations, elements, components, and/or groups thereof.

The term "at least one" should be understood as including any and all combinations of one or more of the associated listed items. For example, the meaning of "at least one of a first item, a second item, and a third item" denotes the combination of all items proposed from two or more of the first item, the second item, and the third item as well as the first item, the second item, or the third item.

Hereinafter, an organic light emitting display device and a driving method thereof according to the present embodiments will be described in detail with reference to the accompanying drawings.

Figure 2:
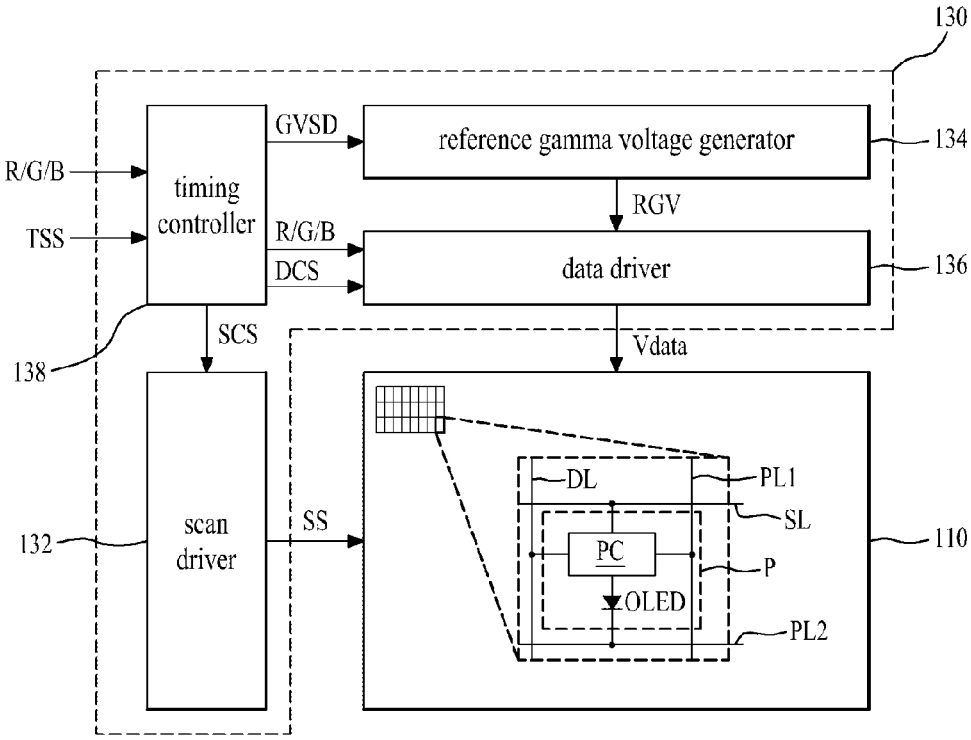
FIG. 2 is a diagram for describing an organic light emitting display device according to a present embodiment.

FIG. 2 is a diagram for describing an organic light emitting display device according to an example embodiment.

With reference to FIG. 2, the organic light emitting display device may include: a display panel 110 that is configured with a plurality of pixels P including an organic light emitting element (for example, an organic light emitting diode) ("OLED") that emits light with a current corresponding to a data voltage ("Vdata"); and a panel driver 130 that divides the display panel 110 into first to Mth blocks, calculates an average picture level of each of the blocks from data R/G/B to be displayed in each pixel of each block, and controls the data voltage (Vdata) of each pixel P to be displayed in each block on the basis of an average picture level of M number of previous blocks at every display time of each block.

In the display panel 110, the organic light emitting element OLED of each pixel P may emit light with the data voltage (Vdata) supplied from the panel driver 130, and thus, a certain color image is displayed with light emitted from each pixel P. To this end, the display panel 110 includes a plurality of data lines DL and a plurality of scan lines SL that intersect each other to define a plurality of pixel areas, a plurality of first power lines PL1 that are formed in parallel to the plurality of data lines DL, and a plurality of second power lines PL2 that are formed to intersect the plurality of first power lines PL1.

The plurality of data lines DL may be arranged at certain intervals in a first direction, and the plurality of scan lines SL may be arranged at certain intervals in a second direction intersecting the first direction. The plurality of first power lines PL1 may be arranged in parallel to be adjacent to the plurality of data lines DL, and may receive first driving power from the outside.

The plurality of second power lines PL2 may be arranged to intersect the plurality of first power lines PL1, and may receive second driving power. Here, the second driving power may have a low-level voltage level lower than the first driving power, and/or may have a ground voltage level.

The display panel 110 may include a cathode electrode layer (not shown) instead of the plurality of second power lines PL2. In this case, the cathode electrode layer may be formed all over a display area (for example, an entirety of the display area) of the display panel 110, and may receive the second driving power from the outside.

Each of the plurality of pixels P may be formed in one of red, green, blue, and white. Therefore, a unit pixel for displaying one color image may be configured with an adjacent red pixel, green pixel, and blue pixel, or may be configured with an adjacent red pixel, green pixel, blue pixel, and white pixel. As a result, the unit pixel may be configured with pixels of at least three colors.

Each of the plurality of pixels P may include an organic light emitting element OLED and a pixel circuit PC.

The organic light emitting element OLED may be connected to the pixel circuit PC and a corresponding second power line PL2, and may emit light in proportion to a data current supplied from the pixel circuit PC to emit certain color light. To this end, the organic light emitting element OLED includes an anode electrode (e.g., a pixel electrode) connected to the pixel circuit PC, a cathode electrode (e.g., a reflective electrode) connected to the second power line PL2, and an emission cell that is formed between the anode electrode and the cathode electrode to emit light of, for example, one of red, green, blue, and white color. Here, the emission cell may be formed to have a structure of a hole transport layer/organic emission layer/electron transport layer or a structure of a hole injection layer/hole transport layer/organic emission layer/electron transport layer/electron injection layer. The emission cell may further include a function layer for enhancing the emission efficiency and/or service life of the organic emission layer.

The pixel circuit PC may cause a data current, corresponding to a data voltage (Vdata) supplied from the panel driver 130 to a corresponding data line DL, to flow in the organic light emitting element OLED in response to a scan signal SS supplied from the panel driver 130 to a corresponding scan line SL. To this end, the pixel circuit PC includes a switching transistor, a driving transistor, and at least one capacitor which are formed on a substrate by, for example, a process of forming a thin film transistor (TFT).

The switching transistor may be turned on according to a scan signal SS supplied from the scan line SL, and may supply the data voltage (Vdata), supplied through the data line DL, to the driving transistor. The driving transistor is turned on with the data voltage (Vdata) supplied through the switching transistor to thereby supply a data current based on the data voltage (Vdata) to the organic light emitting element OLED, the organic light emitting element OLED thereby emitting light in proportion to the data current. The at least one capacitor can hold the data voltage supplied to the driving transistor during one frame.

However, a threshold voltage/mobility deviation of the driving transistor can occur in the pixel circuit PC of each pixel P during the that the driving transistor is driven, causing a reduction in image quality. Therefore, the organic light emitting display device according to the present embodiments may further include a compensation circuit for compensating for the threshold voltage of the driving transistor.

The compensation circuit may be configured in an internal compensation scheme in which the pixel circuit PC internally compensates for the threshold voltage of the driving transistor, or may be configured in an external compensation scheme in which the panel driver 130 compensates for the threshold voltage of the driving transistor.

The compensation circuit using the internal compensation scheme may be configured with at least one compensation transistor and at least one compensation capacitor which are formed in the pixel circuit PC. The internal compensation scheme is a scheme that stores both a data voltage and the threshold voltage of the driving transistor in the capacitor during a detection period in which the threshold voltage of the driving transistor is detected, and compensates for the threshold voltage of the driving transistor.

The compensation circuit using the external compensation scheme may include a sensing transistor connected to the driving transistor of the pixel circuit PC, a sensing line that is formed in the display panel 110 to be connected to the sensing transistor, and a sensing circuit that is formed in the panel driver 130 to be connected to the sensing line. The compensation circuit using the external compensation scheme may sense the threshold voltage of the driving transistor through the sensing line by using the sensing circuit when the sensing transistor is being driven, and may compensate for the threshold voltage of the driving transistor of each pixel P by compensating for data RGB to be displayed in each pixel P on the basis of the sensed threshold voltage of the driving transistor. Further, the compensation circuit using the external compensation scheme may sense a voltage corresponding to a mobility of the driving transistor through the sensing line by using the sensing circuit when the sensing transistor is being driven, and may compensate for the sensed voltage.

The panel driver 130 may divide the display panel 110 into first to Mth blocks, calculate an average picture level of each of the blocks from RGB data to be displayed in respective pixels of each block, convert the RGB data of each block into data voltages (Vdata), and supply the data voltages to respective pixels P of each block. For example, the panel driver 130 may control data voltages of respective pixels P to be displayed in the ith block (where i is a natural number that is one of one to M) on the basis of an average picture level of M number of blocks previous to the ith block at a display time of the ith block. To this end, the panel driver 130 includes a scan driver 132, a reference gamma voltage generator 134, a data driver 136, and a timing controller 138.

The scan driver 132 may generate the scan signal SS according to a scan control signal SCS supplied from the timing controller 138, and may supply the scan signal SS to the plurality of scan lines SL. The scan driver 132 may be provided in a non-display area of the display panel 110, for example, according to a gate-in panel (GIP) type in which the scan driver 132 is provided in the above-described process of forming the TFT of the display panel 110, or the scan driver 132 may be implemented as a chip type and mounted on the non-display area in a chip-on-glass (COG) type.

The gamma reference voltage generator 134 may be implemented as a programmable gamma integrated circuit (IC) that generates a plurality of different reference gamma voltages RGV with gamma voltage setting data GVSD supplied from the timing controller 138. The reference gamma voltage generator 134 may set a voltage level of a high-level voltage used to generate reference gamma voltages from a power supply (not shown) with the gamma voltage setting data GVSD, may voltage-divide between a low-level voltage and a high-level voltage to generate the plurality of reference gamma voltages RGV having different voltage levels, and may supply the plurality of reference gamma voltages RGV to the data driver 136. At this time, the reference gamma voltage generator 134 may generate the plurality of reference gamma voltages RGV that are used in each pixel of a unit pixel in common, or may generate the plurality of reference gamma voltages RGV by color separately and/or independently for each pixel of the unit pixel.

The data driver 136 may receive a data control signal DCS and data R/G/B of each pixel P supplied from the timing controller 138, and may receive the plurality of reference gamma voltages RGV from the reference gamma voltage generator 134. The data driver 136 may convert the data R/G/B of each pixel P into analog data voltages (Vdata) by using the plurality of reference gamma voltages RGV according to the data control signal DCS, and may supply the Vdata to a data line DL of each pixel P in units of a horizontal period of the display panel 110.

The timing controller 138 may include a control signal generator (not shown) that generates the scan control signal SCS for controlling a driving timing of the scan driver 132 and the data control signal DCS for controlling a driving timing of the data driver 134. The control signal generator may generate the scan control signal SCS and the data control signal DCS on the basis of a timing sync signal TSS that includes a vertical sync signal (Vsync), a horizontal sync signal (Hsync), a data enable signal (DE), and/or a clock (DCLK).

Moreover, the timing controller 138 may include a data processor that divides the display panel 110 into the first to Mth blocks on the basis of a scan direction of the display panel 110 according to driving of the scan driver 132, calculate an average picture level of each of the first to Mth blocks from the input data R/G/B, and set the gamma voltage setting data GVSD or correct the data R/G/B of each pixel P to be displayed in the ith block on the basis of the average picture level of M number of blocks previous to the ith block at a display time of the ith block.

Figure 3:
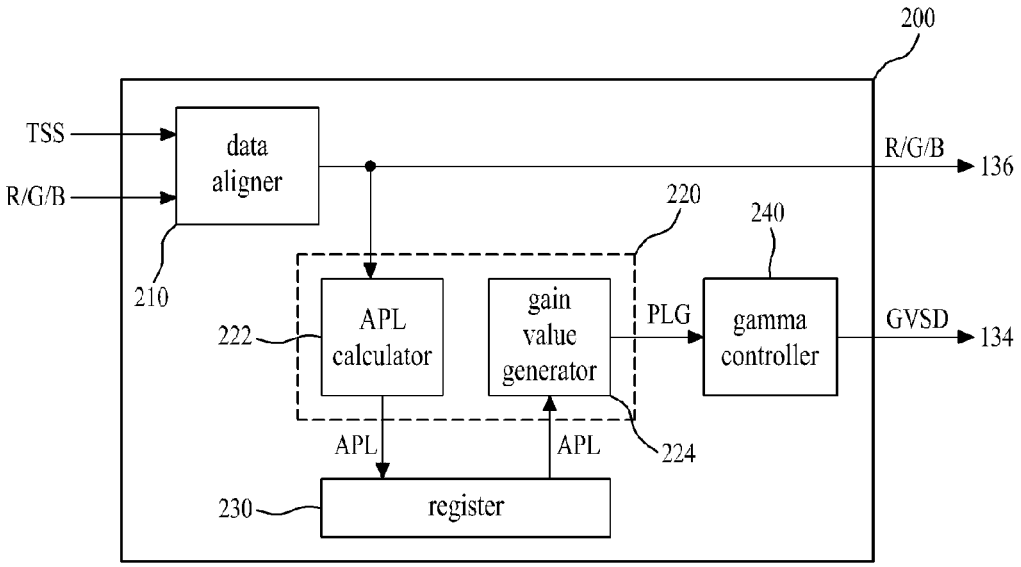
FIG. 3 is a block diagram for describing a first embodiment of a data processor included in a timing controller of FIG. 2.

FIG. 3 is a block diagram for describing a first embodiment of the data processor included in the timing controller of FIG. 2.

With reference to FIG. 3, a data processor 200 according to the first embodiment may include a data aligner 210, a peak luminance controller 220, a register 230, and a gamma controller 240.

The data aligner 210 may align data R/G/B of each pixel P inputted, for example, from an external system body (not shown) or a graphics card (not shown), so as to properly match a pixel arrangement structure of the display panel 110, and may supply the aligned data R/G/B to the data driver 136 according to a predetermined data interface type.

The peak luminance controller 220 may include an APL calculator 222 and a gain value generator 224.

Figure 4:
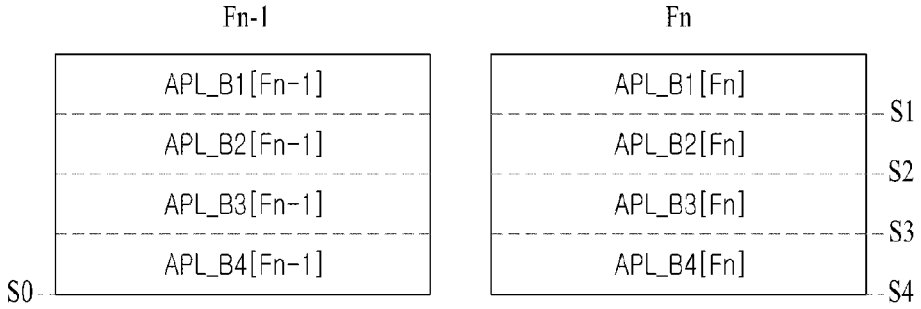
FIG. 4 is a diagram for describing a method of calculating an average picture level of each block with an APL calculator of FIG. 2.

The APL calculator 222 may calculate an average picture level APL of each block from the aligned data R/G/B outputted from the data aligner 210, and may store the calculated average picture level in the register 230. For example, the APL calculator 222 calculates an average grayscale value (which is an average picture level of each block) of the data R/G/B to be displayed in a plurality of pixels P included in each block. In the following description, as illustrated in FIG. 4, it is assumed that the APL calculator 222 calculates respective average picture levels APL_B1, APL_B2, APL_B3 and APL_B4 of first to fourth blocks B1 to B4 of the display panel 110.

The gain value generator 224 may read the average picture levels APL (stored in the register 230) of the M blocks previous to the ith block at the display time of the ith block among the first to fourth blocks B1 to B4, and may calculate an average value of the read average picture levels APL of the M blocks previous to the ith block to generate a peak luminance gain value PLG. For example, when the ith block is the second block of the display panel 110, the average picture levels APL of the M blocks previous to the ith block may be an average picture level based on data displayed in the first block B1 of a current frame B1 and an average picture level based on data displayed in each of the second to fourth blocks B2 to B3 during a previous frame Fn−1.

For example, as shown in the following Table 1, the gain value generator 224 calculates, as an average picture level LC_APL for luminance control, an average value of average picture levels of (for example) the previous four blocks already displayed in the display panel 110 at every display time S0, S1, S2, S3, and S4 of each block. For example, at the display time S1 of the first block B1, the gain value generator 224 calculates, as an average picture level LC_APL for luminance control of the first block B1, an average value ((APL_B2[Fn−1]+APL_B3[Fn−1]+APL_B4[Fn−1]+APL_B1[Fn])/4) of average picture levels APL_B2[Fn−1], APL_B3[Fn−1], and APL_B4[Fn−1] of the second to fourth blocks B2 to B4 of the previous frame Fn−1 and an average picture level APL_B1 [Fn] of the first block B1 of a current frame Fn.

TABLE 1

| PLC TIMING | LC_APL |
|---|---|
| S0/APL_Fn − 1 | (APL_B1[Fn − 1] + APL_B2[Fn − 1] + APL_B3[Fn − 1] + APL_B4[Fn − 1])/4 |
| S1 | (APL_B2[Fn − 1] + APL_B3[Fn − 1] + APL_B4[Fn − 1] + APL_B1[Fn])/4 |
| S2 | (APL_B3[Fn − 1] + APL_B4[Fn − 1 ] + APL_B1[Fn] + APL_B2[Fn])/4 |
| S3 | (APL_B4[Fn − 1] + APL_B1[Fn] + APL_B2[Fn] + APL_B3[Fn])/4 |
| S4/APL_Fn | (APL_B1[Fn] + APL_B2[Fn] + APL_B3[Fn] + APL_B4[Fn])/4 |

Subsequently, the gain value generator 224 may generate the peak luminance gain value PLG on the basis of the average picture level LC_APL for luminance control. In this case, the peak luminance gain value PLG is generated within a range from 1 to k. As the average picture level LC_APL for luminance control becomes higher, the peak luminance gain value PLG decreases to a value of 1, and as the average picture level LC_APL for luminance control becomes lower, the peak luminance gain value PLG increases to a value of k. Here, a luminance displayed in the display panel 110 is controlled to within a value of k times the luminance range at the minimum luminance, according to the peak luminance gain value PLG.

The gain value generator 224, as shown in FIG. 4 and Table 1, may calculate an average frame picture level on the basis of an average value of average picture levels APL (stored in the register 230) of the first to fourth blocks B1 to B4 at every display completion time S0 to S4 of one frame, and may store the calculated average frame picture level. Then, the gain value generator 224 may generate the peak luminance gain value PLG to be applied to a current frame Fn on the basis of average frame picture levels (stored in the register 230) of first and second previous frames Fn−1 and Fn−2 (previous to the current frame Fn) at every display completion time S0 to S4 of one frame. That is, because the gain value generator 224 may calculate only an average picture level of each block without using a frame memory, the gain value generator 224 may not be able to calculate an average frame picture level of a previous frame Fn−1, and thus, the gain value generator 224 may calculate an average frame picture level at every display completion time of each frame, store the calculated average frame picture level in the register 230, and generate the peak luminance gain value PLG according to average frame picture levels of the first and second previous frames Fn−1 and Fn−2 stored in the register 230.

Figure 5:
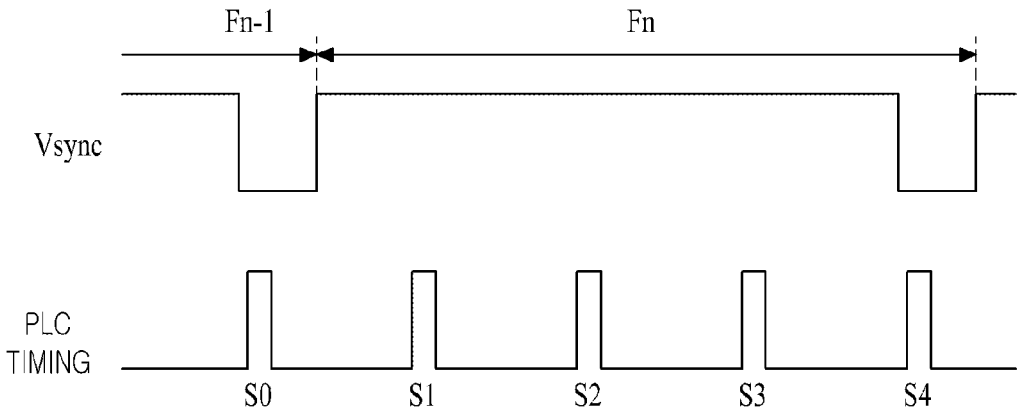
FIGS. 5 and 6 are diagrams for describing a peak luminance control method according to the present embodiments.

For example, at the display completion time S0 of the first previous frame Fn−1, when an average frame picture level APL_Fn−1 of the first previous frame Fn−1 is higher than an average frame picture level APL_Fn−2 of the second previous frame Fn−2, as shown in FIG. 5, the gain value generator 224 may generate the peak luminance gain value PLG according to the average picture level LC_APL for luminance control calculated at every peak luminance control time PLC TIMING corresponding to each of the display times S0 to S4 of the respective blocks B1 to B4 of the current frame Fn as described above, and thus may allow a luminance of the current frame Fn to be adjusted for each of the blocks B1 to B4. That is, the gain value generator 224 may compare the respective average frame picture levels of the first and second previous frames Fn−1 and Fn−2, and only when an image of one frame is changed from a dark image to a bright image, the gain value generator 224 may generate the peak luminance gain value PLG to allow a luminance of the current frame Fn to be adjusted for each of the blocks B1 to B4, thus preventing an adverse effect due to a momentary peak current.

Figure 6:
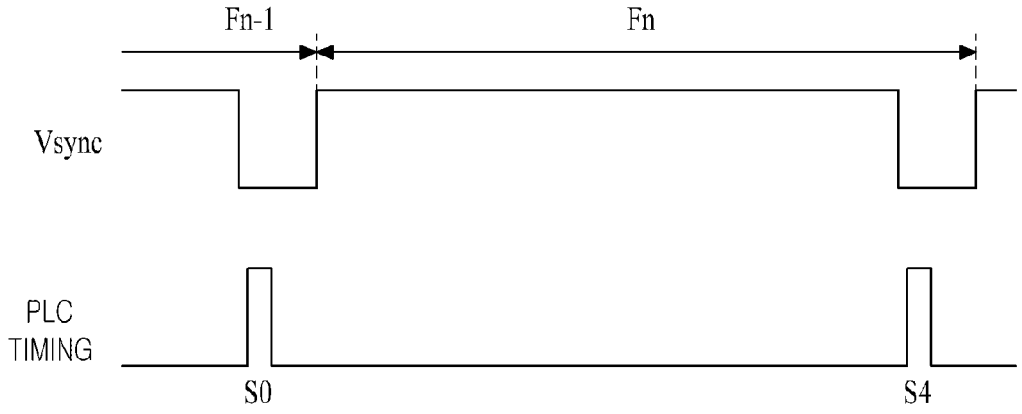

On the other hand, at the display completion time of the previous frame Fn−1, when the average frame picture level APL_Fn−1 of the first previous frame Fn−1 is equal to or less than the average frame picture level APL_Fn−2 of the second previous frame Fn−2, as shown in FIG. 6, the gain value generator 224 may generate the peak luminance gain value PLG according to the average frame picture level APL_Fn−1 of the first previous frame Fn−1 at the peak luminance control time PLC TIMING corresponding to each of the display completion time S0 of the first previous frame Fn−1, and thus may allow the luminance of the current frame Fn to be adjusted once.

The gamma controller 240 may set the gamma voltage setting data GVSD for setting the maximum luminance value of data R/G/B on the basis of the peak luminance gain value PLG supplied from the gain value generator 224, and may supply the gamma voltage setting data GVSD to the reference gamma voltage generator 134.

As described above, the data processor 200 according to the first embodiment may generate the peak luminance gain value PLG for controlling a peak current by using the register 230 without using a separate frame memory.

Figure 7:
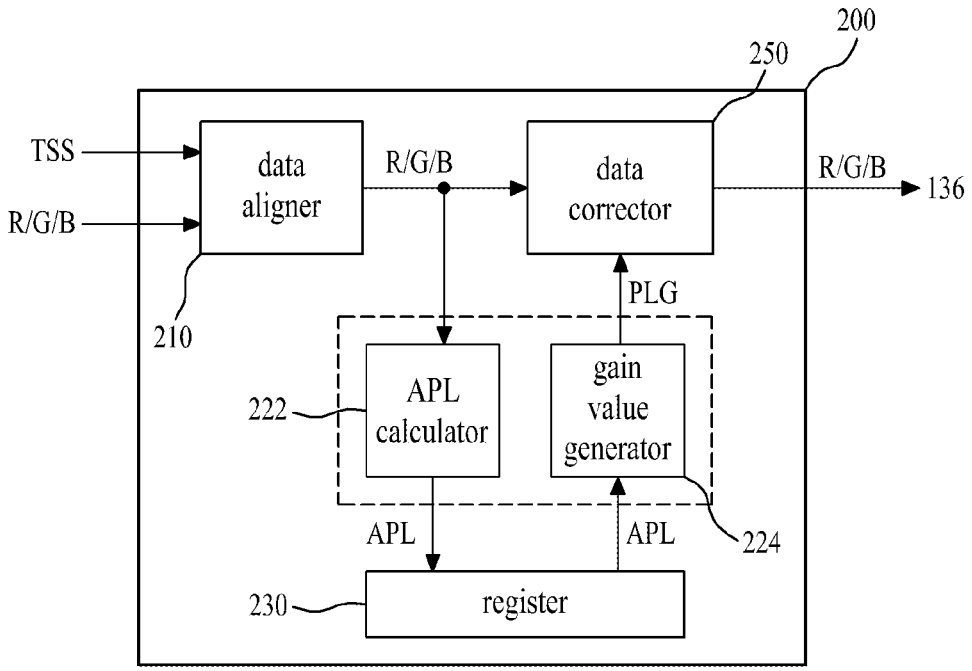
FIG. 7 is a block diagram for describing a second embodiment of a data processor included in the timing controller of FIG. 2.

FIG. 7 is a block diagram for describing a second embodiment of a data processor included in the timing controller of FIG. 2.

With reference to FIG. 7, a data processor 200 according to the second embodiment may include the data aligner 210, the peak luminance controller 220, the register 230, and a data corrector 250. The data processor 200 according to the second embodiment having such a configuration may not include the gamma controller 240, but may include this data corrector 250.

The data aligner 210 may align data R/G/B of each pixel P inputted from, for example, the external system body (not shown) or the graphics card (not shown), so as to properly match a pixel arrangement structure of the display panel 110, and may supply the aligned data R/G/B to the data corrector 250.

The peak luminance controller 220 may include an APL calculator 222 and a gain value generator 224. The peak luminance controller 220 may be similar to the above description, and thus, a repetition of this description is not provided.

The data corrector 250 may correct data R/G/B (supplied from the data aligner 210) of a block to be displayed in the display panel 110 on the basis of the peak luminance gain value PLG outputted from the peak luminance controller 220. For example, the data corrector 250 may additionally calculate a correction value based on a grayscale value of the data R/G/B of each pixel P included in a block to be displayed in the display panel 110 and the peak luminance gain value PLG, and may correct the grayscale value of the data R/G/B by using the calculated correction value. As another example, the data corrector 250 may multiply the peak luminance gain value PLG by the grayscale value of the data R/G/B of each pixel P included in the block to be displayed in the display panel 110 to affect correction.

The data corrector 250 may supply the corrected data R/G/B to the data driver 136 according to a predetermined data interface type.

As described above, the data processor 200 according to the second embodiment may generate the peak luminance gain value PLG for controlling a peak current by using the register 230 without using a separate frame memory.

The above-described organic light emitting display device and driving method according to the present embodiments may calculate an average picture level of each block defined in the display panel 110 in real time, store the average picture level in the register 230, and set the gamma voltage setting data GVSD or correct data according to the peak luminance gain value PLG on the basis of an average picture level of each block stored in the register 230, to thereby control a peak luminance of the display panel 110 with no adverse effect (for example, a shutdown of the device) caused by a momentary peak current.

In the above-described organic light emitting display device and driving method according to the present embodiments, it has been described that the display panel 110 is divided into four blocks, but the number of blocks of the display panel 110 and a time for applying a peak luminance may be variously set according to the size, resolution, and peak luminance control scheme of the display panel 110, without being limited thereto.

As described above, the organic light emitting display device and the driving method thereof according to the present embodiments can control a peak luminance with no adverse effect caused by a momentary peak current, without using a frame memory. Because the frame memory is not used, the manufacturing cost can be reduced.

It will be apparent to those skilled in the art that various modifications and variations can be made in the present embodiments without departing from their spirit or scope. Thus, it is intended that the present embodiments covers modifications and variations provided that they come within the scope of the appended claims and their equivalents.

What is claimed is:

1. An organic light emitting display device comprising:

a display panel including a plurality of pixels each having an organic light emitting element that emits light according to a current corresponding to a data voltage; and a panel driver configured to:

divide the display panel into first to Mth blocks, each of the first to Mth blocks having a plurality of lines of pixels, calculate an average grayscale value of data to be displayed in the plurality of pixels of each block as an average picture level of each block, convert the data to be displayed by each of the plurality of pixels of each block into the data voltage, and supply the data voltage to each of the plurality of pixels of each block, wherein the panel driver controls the data voltage to be supplied to an ith block on the basis of the average picture levels of M number of blocks driven previous to the ith block, where i is a natural number from 1 to M;

wherein the panel driver comprises a timing controller configured to:

calculate the average picture levels of each block, store the calculated average picture levels, calculate an average picture level for luminance control on the basis of the average picture levels of the M blocks driven previous to the ith block at a display time of the ith block, and generate a peak luminance gain value according to the average image level for luminance control, wherein the timing controller is configured to calculate an average frame picture level on the basis of the stored respective average picture levels of the first to Mth blocks at every display completion time of one frame, and adjust the peak luminance gain value according to a comparison of the respective average frame picture levels of first and second previous frames that are previous to a current frame.

2. The organic light emitting display device of claim 1, wherein the timing controller is further configured to:

generate gamma voltage setting data corresponding to the peak luminance gain value;

the panel driver further including:

a reference gamma voltage generator configured to generate a plurality of reference gamma voltages with the gamma voltage setting data; and a data driver configured to:

convert data, supplied from the timing controller, of each pixel to be displayed in the ith block into the data voltage by using the plurality of reference gamma voltages, and supply the data voltage to each pixel of the ith block.

3. The organic light emitting display device of claim 1, wherein, when the average frame picture level of the first previous frame is higher than the average frame picture level of the second previous frame, the timing controller generates the peak luminance gain value according to the average frame picture level for luminance control calculated at every display time of the ith block, and when the average frame picture level of the first previous frame is equal to or less than the average frame picture level of the second previous frame, the timing controller generates the peak luminance gain value according to the average frame picture level of the first previous frame.

4. The organic light emitting display device of claim 3, wherein when the average frame picture level of the first previous frame is equal to or less than the average frame picture level of the second previous frame, the timing controller generates the peak luminance gain value according to the average frame picture level of only the first previous frame.

5. The organic light emitting display device of claim 1, wherein the timing controller is further configured to:

correct data of each pixel to be displayed in the ith block according to the peak luminance gain value;

the panel driver further including:

a reference gamma voltage generator configured to generate a plurality of reference gamma voltages; and a data driver configured to:

convert the corrected data, supplied from the timing controller, of each pixel to be displayed in the ith block into the data voltage by using the plurality of reference gamma voltages, and supply the data voltage to each pixel of the ith block.

6. The organic light emitting display device of claim 1, wherein, when an average frame picture level of the first previous frame is higher than an average frame picture level of the second previous frame, the timing controller generates the peak luminance gain value according to the average frame picture level for luminance control calculated at every display time of the ith block, and when the average frame picture level of the first previous frame is equal to or less than the average frame picture level of the second previous frame, the timing controller generates the peak luminance gain value according to the average frame picture level of the first previous frame.

7. The organic light emitting display device of claim 1, wherein the average picture levels of the M number of blocks are stored in a register.

8. A method of an organic light emitting display device, including a display panel that has plurality of pixels each having an organic light emitting element that emits light according to a current corresponding to a data voltage, the method comprising:

performing an A operation of dividing the display panel into first to Mth blocks, each of the first to Mth blocks having a plurality of lines of pixels, and calculating an average grayscale value of data to be displayed in the plurality of pixels of each block as an average picture level of each block; and performing a B operation of converting the data to be displayed in each of the plurality of pixels of each block into the data voltage to thereby supply the data voltage to each pixel simultaneously with the A operation, wherein the B operation controls the data voltage to be supplied to an ith block on the basis of the average picture levels of M number of blocks driven previous to the ith block, where i is a natural number from 1 to M, wherein the B operation comprises:

storing the calculated average picture levels;

calculating an average picture level for luminance control on the basis of the average picture levels of the M blocks driven previous to the ith block at a display time of the ith block, generating a peak luminance gain value according to the average picture levels for luminance control;

generating a peak luminance gain value; and calculating an average frame picture level on the basis of the respective average picture levels of the first to Mth blocks at every display completion time of one frame, and generating the peak luminance gain value according to the respective average frame image levels of first and second previous frames driven previous to a current frame.

9. The method of claim 8, wherein the B operation further comprises:

generating the peak luminance gain value according to the average picture levels for luminance control, generating gamma voltage setting data corresponding to the peak luminance gain value, and generating a plurality of reference gamma voltages with the gamma voltage setting data; and converting data, supplied from the timing controller, of each pixel to be displayed in the ith block into the data voltage by using the plurality of reference gamma voltages, and supplying the data voltage to each pixel of the ith block.

10. The method of claim 8, wherein the generating of the peak luminance gain value comprises:

when an average frame picture level of the first previous frame is higher than an average frame picture level of the second previous frame, generating the peak luminance gain value according to the average picture level for luminance control calculated at every display time of the ith block; and when the average frame picture level of the first previous frame is equal to or less than the average frame picture level of the second previous frame, generating the peak luminance gain value according to the average frame picture level of the first previous frame.

11. The method of claim 10, wherein when the average frame picture level of the first previous frame is equal to or less than the average frame picture level of the second previous frame, generating the peak luminance gain value according to the average frame picture level of only the first previous frame.

12. The method of claim 8, wherein the B operation further comprises:

correcting data of each pixel to be displayed in the ith block according to the peak luminance gain value;

generating a plurality of reference gamma voltages; and converting the corrected data, supplied from the timing controller, of each pixel to be displayed in the ith block into the data voltage by using the plurality of reference gamma voltages, and supplying the data voltage to each pixel of the ith block.

13. The method of claim 8, wherein the generating of the peak luminance gain value comprises:

when an average frame picture level of the first previous frame is higher than an average frame picture level of the second previous frame, generating the peak luminance gain value according to the average picture level for luminance control calculated at every display time of the ith block; and when the average frame picture level of the first previous frame is equal to or less than the average frame picture level of the second previous frame, generating the peak luminance gain value according to the average frame picture level of the first previous frame.

14. The method of claim 8, wherein the average picture levels of the M number of blocks are stored in a register.

* * * * *